US007299945B2

(12) United States Patent
Tsubaki et al.

(10) Patent No.: US 7,299,945 B2
(45) Date of Patent: Nov. 27, 2007

(54) DISCHARGE CONTAINER WITH ONE-WAY VALVES

(75) Inventors: Tatsuo Tsubaki, Tokyo (JP); Shigeo Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 405 days.

(21) Appl. No.: 10/516,286

(22) PCT Filed: Sep. 30, 2003

(86) PCT No.: PCT/JP03/12438

§ 371 (c)(1),
(2), (4) Date: Jan. 4, 2005

(87) PCT Pub. No.: WO2004/028925

PCT Pub. Date: Apr. 8, 2004

(65) Prior Publication Data

US 2006/0151539 A1 Jul. 13, 2006

(30) Foreign Application Priority Data

Sep. 30, 2002 (JP) ..... 2002-287155

(51) Int. Cl.
*B65D 35/56* (2006.01)

(52) U.S. Cl. ..... 222/105; 222/106; 222/192; 222/481.5

(58) Field of Classification Search ..... 222/92, 222/105, 106, 192, 481.5, 490, 494; 132/112, 132/113, 116
See application file for complete search history.

(56) References Cited

U.S. PATENT DOCUMENTS 3,995,772 A 12/1976 Liautaud
4,209,027 A * 6/1980 Morganroth ..... 132/212
4,842,165 A 6/1989 Van Coney
5,332,121 A * 7/1994 Schmidt et al. ..... 222/95
6,581,803 B1 * 6/2003 Yoshimoto et al. ..... 222/105
6,675,812 B1 * 1/2004 Wiley ..... 132/108
6,959,840 B2 * 11/2005 Iwatsubo ..... 222/94
2001/0040173 A1 * 11/2001 Yamamoto et al. ..... 222/106

FOREIGN PATENT DOCUMENTS

| | | |
|---|---|---|
| EP | 0 305 003 A1 | 3/1989 |
| EP | 0 829 432 A1 | 3/1998 |
| EP | 1 153 845 A1 | 11/2001 |
| JP | 41-24522 | 12/1941 |
| JP | A 6-27523 | 2/1994 |
| JP | A 7-24738 | 1/1995 |
| JP | A 8-131238 | 5/1996 |
| JP | A 10-114360 | 5/1998 |
| JP | A 2000-62861 | 2/2000 |
| JP | 2001-146260 A | 5/2001 |
| JP | A 2002-129195 | 5/2002 |

* cited by examiner

*Primary Examiner*—Joseph A. Kaufman
(74) *Attorney, Agent, or Firm*—Oliff & Berridge, PLC

(57) ABSTRACT

A squeezable laminated discharge container of the delaminatable type in which the layers can be easily broken away from each other comprises a first check valve fitted to the neck and has an opening in a bottom plate. The base cup comprises a second check valve, and is fitted tightly around the container bottom cylinder. In this discharge container, it is sought to secure stable and strong fitting and to maintain tight contact stably, between the container and the base cup.

6 Claims, 12 Drawing Sheets

(a)

(a)

DISCHARGE CONTAINER WITH ONE-WAY VALVES

TECHNICAL FIELD

This invention relates to a discharge container capable of discharging the contents without allowing outside air to enter the inside of the container, and in particular to a discharge container comprising a squeezable container and a base cup, with the container comprising an outer layer molded in a definite shape and laminated with an inner layer in a peelable manner, and the base cup being fitted tightly around the bottom cylinder of the container.

BACKGROUND ART

Prior to this invention, the applicant of this invention filed an application for patent (See patent document 1). That invention related to a discharge container comprising a squeezable container having an outer layer, an inner layer laminated with the outer layer in a manner that the inner layer is peelable from the outer layer, a container neck disposed on top of this squeezable container and used to form a discharge port for the contents, and an opening disposed in a part of the outer layer located in the bottom plate of bottom cylinder and used to introduce outside air into the interspace between the outer layer and the inner layer; and also comprising the first check valve used to open or close the neck of the squeezable container so as to prevent the backflow of the contents into the container and the inflow of outside air, a base cup tightly fitted around the bottom cylinder and having an air intake hole disposed in the cup bottom plate, and the second check valve fitted to the air intake hole of the base cup to permit outside air to pass through the air intake hole.

[Patent document 1] P2002-129195 patent specification

In the above-described conventional art, the container bottom has stable strength and a self-standing function because the base cup serves to reinforce the container bottom. However, if the squeezability of the container is enhanced in response to an increasing request for resources saving, the container tends to be much more deformable. Depending on the extent of deformability, there is a fear that the firm fitting strength and reliable sealing property may decrease between the container and the base cup.

DISCLOSURE OF THE INVENTION

A first embodiment solves the above-described technical problem in that the configuration that the discharge container comprises:

a squeezable container, which has an outer layer and an inner layer that are laminated to each other in a manner that the inner layer is peelable from the outer layer, a neck disposed in the upper portion of the container to form a discharge port through which the contents are discharged, and an opening disposed in a part of the outer layer at a position in the bottom plate of container bottom cylinder so as to introduce outside air into the interspace between the outer layer and the inner layer;

the first check valve, which opens or closes the neck to prevent the contents from flowing back into the container and to inhibit the inflow of outside air;

a base cup in a bottomed cylindrical shape, which has a cylindrical wall that comes in screw engagement with the container bottom cylinder and also has an air intake hole opened in the cup bottom plate; and a second check valve fitted to the air intake hole to permit outside air to enter the interspace between layers, wherein airtight fitting of peripheral bottom wall of the container to the cylindrical wall of the base cup is accomplished by tight contact between the first seal disposed on the peripheral bottom wall of the bottom cylinder and the second seal disposed on the back of the cylindrical wall.

In a first embodiment, the body of the squeezable container is squeezed to open the first check valve that has closed the neck. Then, the contents are discharged out of the container through the neck.

The discharge of the contents comes to a halt as soon as the pressure is released. The outer layer begins restoring its original shape because of its own resilient recovering force. The first check valve acts to close the neck and to prevent the inflow of outside air and the backflow of the contents into the container.

At that time, the inner layer has a reduced capacity and remains deformed with the decrease in the contents. As a result, pressure reduction takes place in the interspace between the outer layer that begins restoring its original shape and the inner layer that remains deformed because of a reduced capacity. Under the reduced pressure condition, the second check valve opens the air intake hole in the base cup to introduce outside air through the opening into the interspace between the outer and inner layers. The outer layer quickly returns to its original shape.

After the outer layer has restored its original state, the body of the container can be squeezed again. This second squeeze puts the interspace between the outer and inner layers under a pressurized condition. This pressure is applied on the second check valve to block up the air intake hole, and at the same time, prevents air in the interspace from flowing back and escaping outside.

When the body of the container is squeezed for the second time, the pressure is steadily applied onto the contents inside the deformed inner layer through the air existing between the outer layer and the inner layer. As a result, the first check valve again opens the neck of the container to ensure that the contents are discharged from the container.

Even if the opening is disposed in the bottom cylinder of the container, this bottom cylinder of the container is reinforced by the base cup, which is screwed on and fitted around the bottom cylinder of the container. Therefore, the bottom cylinder of the container is stably kept in shape, and the container has the ability to stand alone firmly under the configuration that the squeezability of the container is enhanced.

A spiral thread ridge for the screw engagement with the base cup is disposed on the peripheral bottom wall of the container bottom cylinder on which the base cup is screwed. Since this spiral thread ridge is prepared by corrugating and deforming the peripheral bottom wall, the corrugated spiral thread ridge serves as a reinforcing rib. Therefore, the base cup remains strongly fitted to the container even if the squeezability of the container is enhanced.

The container is also provided with the first seal, which is in tight contact with the second seal of the base cup to ensure that the peripheral bottom wall of the bottom cylinder is tightly fitted to the cylindrical wall of the base cup. Thus, the tight fitting of the base cup to the container is secured.

A second embodiment includes the features of the first embodiment, and additionally comprises that a lower overhang is disposed on the peripheral bottom wall of the container bottom cylinder and that the first seal is disposed at a position near this lower overhang.

In the second embodiment, the first seal is disposed near by the lower overhang and is in tight contact with the second Seal of the base cup to ensure that the peripheral bottom wall of the container bottom cylinder is tightly fitted to the cylindrical wall of the base cup. Due to the reinforcing effect of this lower overhang, the container bottom cylinder keeps its given shape steadily, and further ensures the tight fitting of the base cup to the container.

A third embodiment includes the features of the first and second embodiments and additionally comprises that an opening is formed by cleaving the pinch-off portion that has been formed in the outer layer of the container bottom plate.

Outer-layer parison and inner-layer parison with no mutual compatibility are co-extruded to obtain laminated parison, which is pressed flat by the mold pinch-off to give the pinch-off portion. A bottom crack is cleaved easily in this pinch-off portion. In the invention of Claim 3, this crack can be formed in the outer layer of the container bottom plate without any troublesome after-mold processing and can be used as the opening.

A fourth embodiment includes the features of the first three embodiments, and additionally comprises that one of the first seal or the second seal has a peripheral projecting ridge structure, with the other one having a smooth peripheral wall structure.

In the fourth embodiment, the tight contact of the first seal with the second seal is in the state of line contact. The tight contact can be strengthened and stabilized by utilizing local resilient deformation.

A fifth embodiment includes the features of embodiments one through four, and additionally comprises that either first seal or the second seal is made of an elastic material in a ring shape, and is fitted to the peripheral bottom wall of the container bottom cylinder or to the cylindrical wall of the base cup.

In the fifth embodiment, the first seal is in tight contact with the second seal through the intermediary of an elastic ring material. The tight contact can be strengthened and stabilized by utilizing the resilient, deforming force of this material.

A sixth embodiment includes the features of the first five embodiments, and additionally comprises that a comb attachment to be fitted to the neck comprises a row of combing teeth supported in a line on the comb-back having an internal main passage that is connected to the neck of the container. Each tooth has front and rear discharge ports opened at a halfway point of the tooth height in the longitudinal direction of teeth and disposed face to face with opposite discharge ports of the next teeth, and the tooth has also a discharge path that connects the discharge ports to the main passage.

In the sixth embodiment, the body of the container is squeezed with the container-holding hand. The squeezed container is deformed, and the contents, a hair dye, are squeezed out directly between teeth. Holding the body, the user combs the hair on the head, and at the same time, can apply the discharged hair dye to hair of the head. By squeezing the body of the container again, the user is free to squeeze out the hair dye between comb teeth so that an adequate amount of the hair dye can be applied continuously onto hair of the head.

PREFERRED EMBODIMENTS OF THE INVENTION

Figure 1:
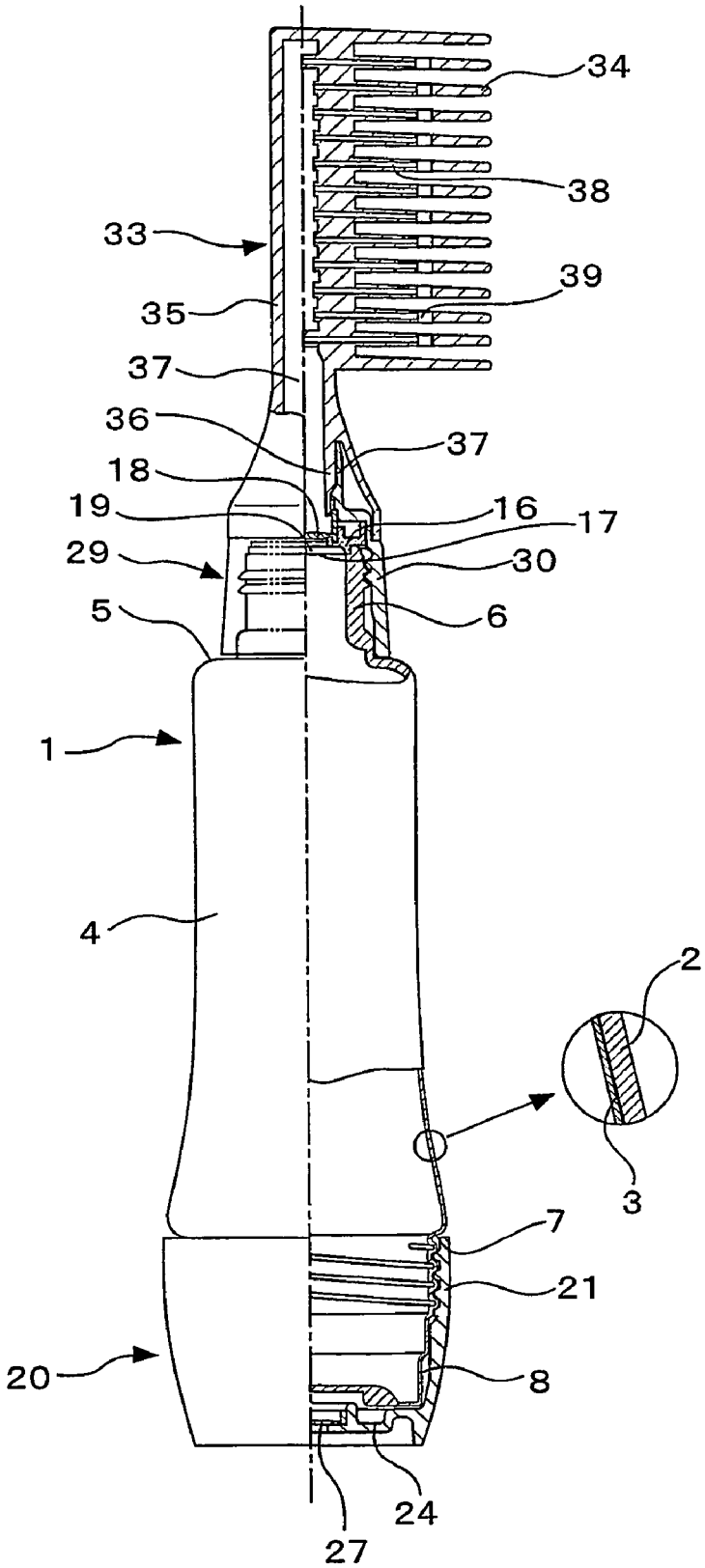
FIG. 1 is an entire side view of the discharge container in one embodiment of this invention, with the right half being a vertical section.

This invention is further described with respect to the preferred embodiments of this invention, now referring to the drawings.

FIG. 1 is an entire side view of the discharge container in one embodiment of this invention, with the comb attachment 33 being fitted to the container. The discharge container comprises the squeezable container 1 and the base cup 20, which has been screwed on, and fitted tightly around, the bottom cylinder 8 of this squeezable container 1. The comb attachment 33 is fitted to the neck 6 of the container 1 by way of a connecting unit 29 in the state in which the internal passage 37 is connected to the neck 6.

The container 1 has a laminated structure in which the outer layer 2 is laminated with the inner layer 3. The outer layer 2 is capable of elastic deformation when it is squeezed, and is recoverable from such deformation. The inner layer 3 is made of a synthetic resin that is less compatible with, and peelable from, the outer layer 2, and is free to deform in response to the reduced amount of the contents. The neck 6 in the shape of a short cylinder is disposed in the upper portion of the body 4 by way of the shoulder 5. A spiral thread ridge is carved on the outer peripheral surface of this neck 6. In order to ensure that the contents can be discharged steadily, it is preferred that at least an adhered strip with a certain narrow width is disposed in the axial direction from neck to bottom. More preferably, two such strips are disposed at symmetric positions.

At the lower end of the body 4 there is the bottom cylinder 8 with closed bottom. The bottom cylinder 8 comprises the peripheral bottom wall 9 and the container bottom plate 13 (See FIG. 2). The peripheral bottom wall 9 is provided with the spiral thread ridge 10, the lower overhang 11, and the first seal 12. The container bottom plate 13 is provided with the pinch-off portion 14 that has been formed in the outer layer 2 by the blow-molding tool at the time when the squeezable container 1 was blow-molded. This pinch-off portion 14 is opened to form an opening 15.

Figure 7:
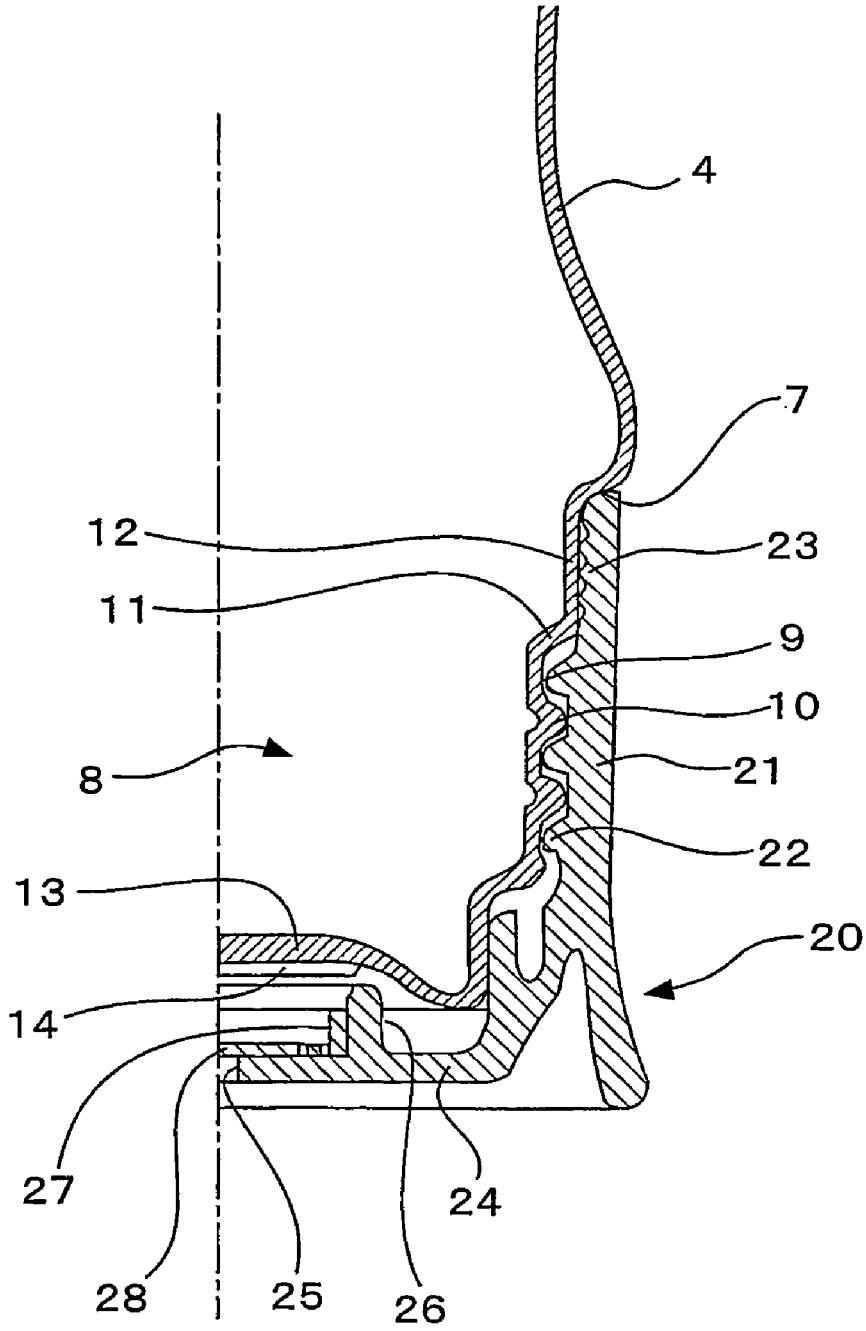
FIG. 7 is a vertical section of the right half of the bottom portion showing the bottom structure in still another embodiment of this invention.

The spiral thread ridge 10 on the bottom cylinder 8 is in itself a peripheral projecting ridge that has been obtained by locally corrugating the peripheral bottom wall 9, and gives strong shape-holding power. In the embodiments shown in FIGS. 2 and 5, the lower overhang 11 is disposed below the thread ridge 10. However, the lower overhang 11 may be disposed above the thread ridge 10, as shown in FIG. 7.

The first seal 12 is disposed near by this overhang 11. In the embodiment shown in FIG. 2, the first seal 12 is integrated with the overhang 11 and gives a peripheral ridge structure. In the embodiment shown in FIG. 5, the first seal 12 has a smooth wall structure, and is located between the spiral thread ridge 10 and the lower overhang 11. In the embodiment shown in FIG. 7, the first seal 12 has a smooth wall structure, and is located between the upper overhang 7 and the lower overhang 11. In all cases, the first seal 12 is combined with a portion that serves as a reinforcing rib, and has a stable and strong shape-holding structure.

Figure 3:
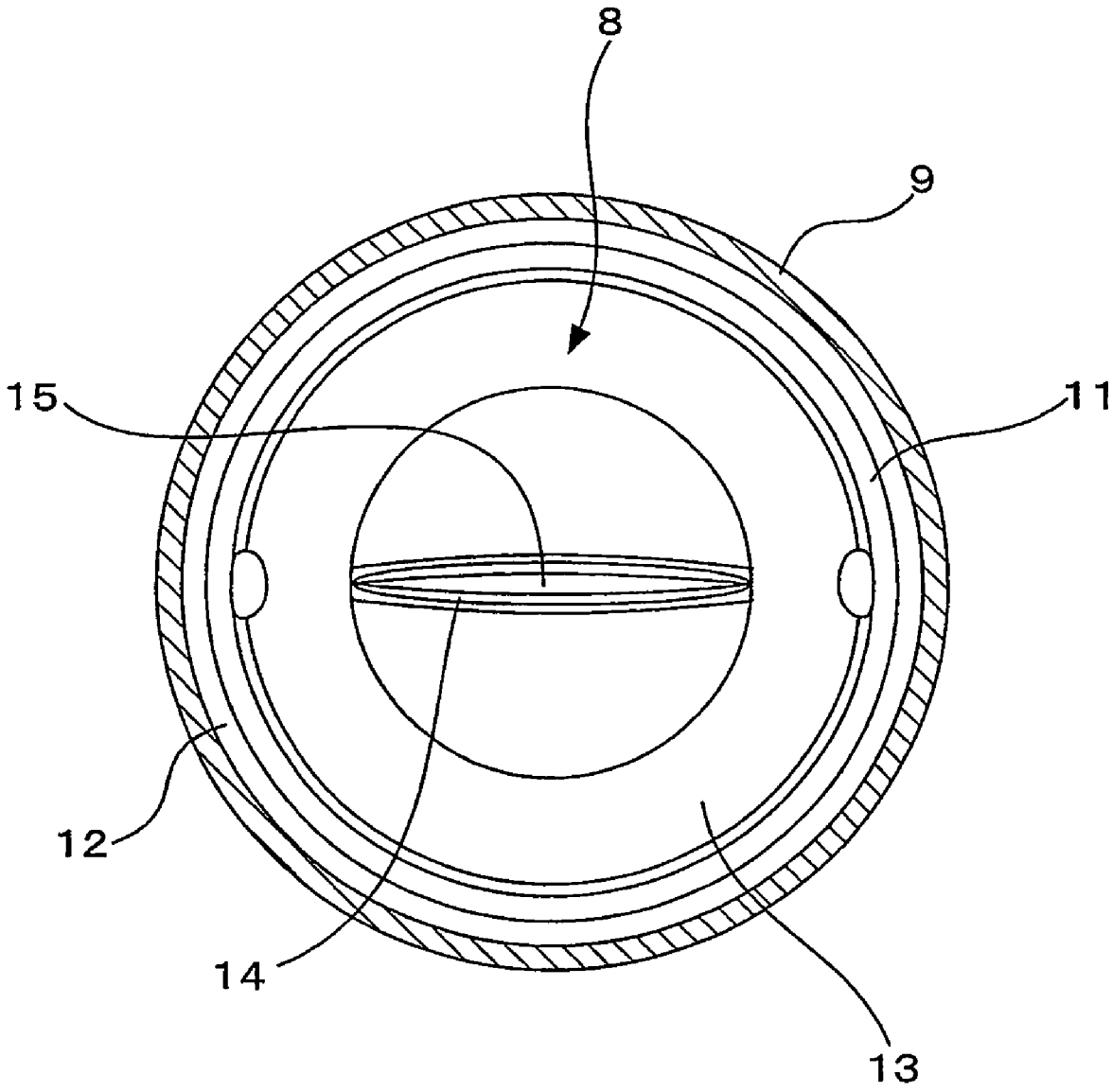
FIG. 3 is a bottom plan view taken when the base cup in the embodiment shown in FIG. 1 is cut into a cross-section.
Figure 4:
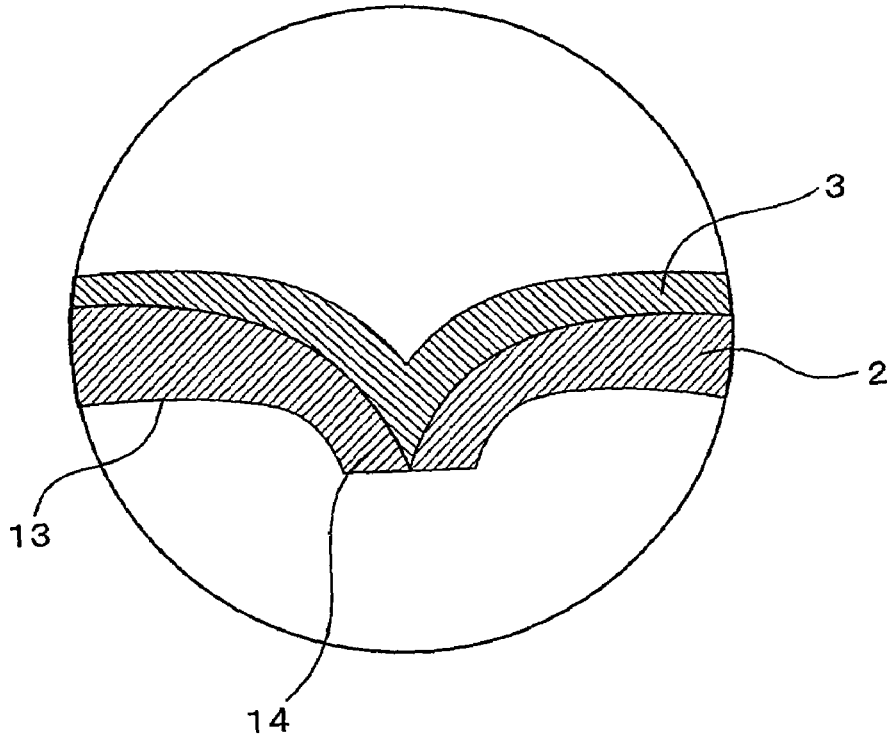
FIG. 4 are enlarged vertical sections of the pinch-off portion of the container bottom plate in the embodiment shown in FIG. 1, in which FIG. 4(*a*) shows the pinch-off portion before the opening is formed, and FIG. 4(*b*) shows the same portion after the opening has been formed.
Figure 4:
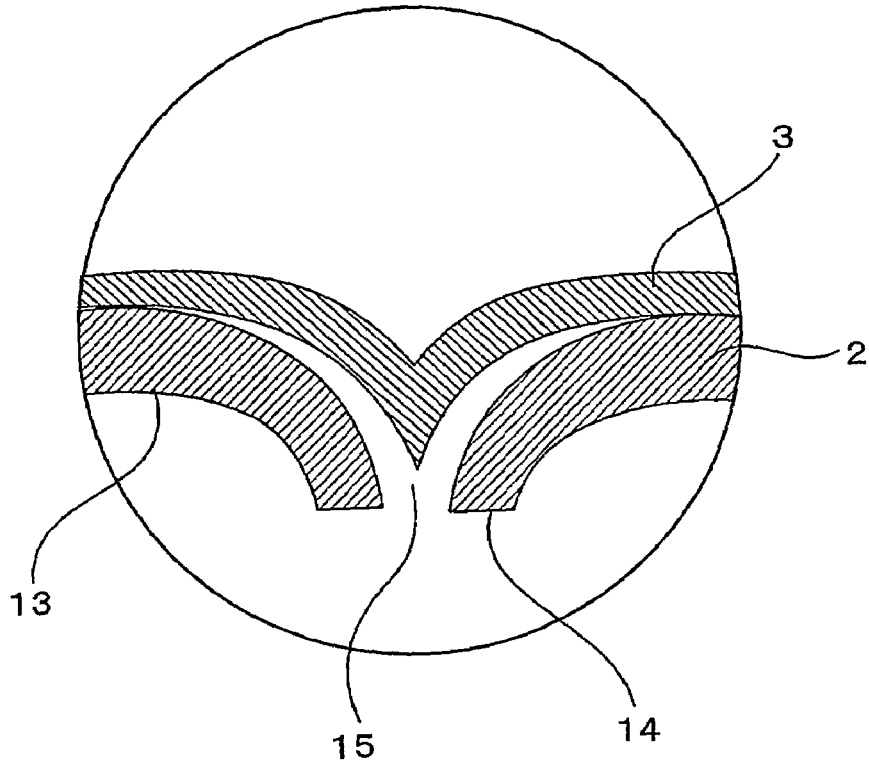

As shown in FIG. 3, the opening 15 is formed along the parting line at the pinch-off portion 14 in the outer layer 2 of the container bottom plate 13. This pinch-off portion 14 is opened by acting the pinching force on the bottom plate 13 along the parting line. Thus, the pinch-off portion 14 in the molded state shown in FIG. 4(*a*) is forced to open, as shown in FIG. 4(*b*).

If the opening 15 was formed as a bottom crack by opening the pinch-off portion 14, the bottom cylinder 8 would naturally have the decreased mechanical strength because of the crack in the bottom cylinder 8. But since the base cup 20 is screwed on, and fitted around, the bottom cylinder 8 to serve as an outer shell, the base cup 20 makes up for any decreased mechanical strength, and thus, the discharge container can stably stand upright.

The first check valve 18 (See FIG. 1) is fitted tightly to the mouth of the neck 6, and in that state, the valve body 19 is disposed at the central opening 17 that has been set up in the center of this inner lid gasket 16. This valve body 19 is actuated to open or close the central opening 17.

The base cup 20 has a bottomed cylindrical shape, in which the cup bottom plate 24 is disposed at the lower end of the cylindrical wall 21, and is fitted around the bottom cylinder 8 in the screw engagement. A spiral thread ridge 22 is carved on the inner cylindrical wall 21 of the base cup 20 and is engaged with the corresponding spiral thread ridge 10. The second seal 23 is formed at a position opposite the first seal 12, and is in tight contact therewith. The air intake hole 25 is opened in the center of the cup bottom plate 24.

Figure 2:
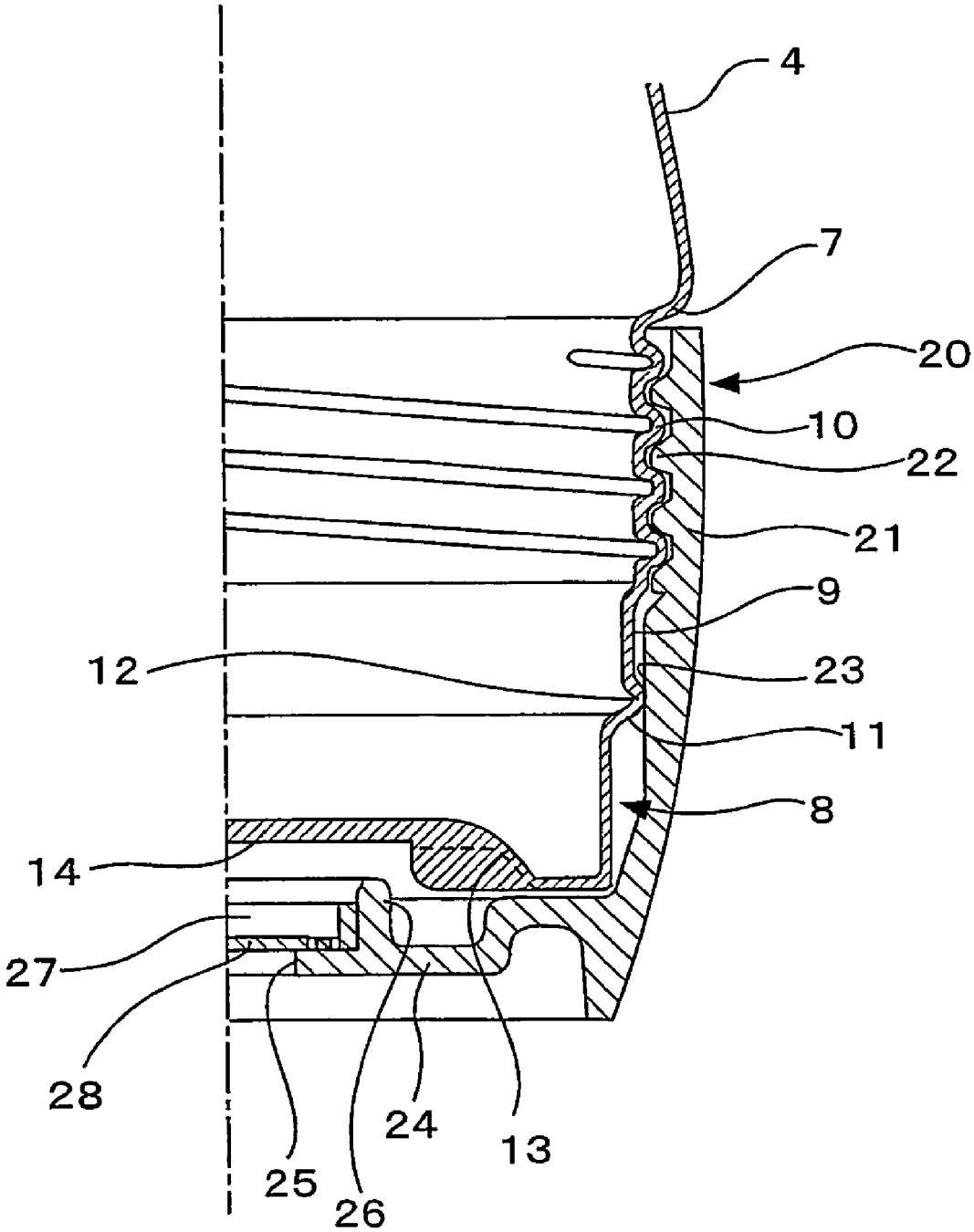
FIG. 2 is a vertical section of the right half of the bottom portion showing the bottom structure in the embodiment shown in FIG. 1.

In the embodiment shown in FIG. 2, the second seal 23 has a smooth wall structure. In the embodiment shown in FIG. 5, the second seal 23 has a peripheral ridge structure. And in the embodiment shown in FIG. 7, it has a structure comprising a combination of plural, small projecting ridges. In all the embodiments described above, the second seal 23 is integrated with the cylindrical wall of the base cup 20. Alternatively, either one of the first seal 12 or the second seal 23 may be made of a ring-like elastic material, such as an O-ring (Not shown), which is fixed to the peripheral bottom wall 9 of the container bottom cylinder 8 or to the inner surface of the cylindrical wall 21 of the base cup 20, or may be made of a sealing member having elastically deformable feet that are pressed to either wall. In such a case, tight contact between the first seal 12 and the second seal 23 can be strengthened and stabilized by utilizing the resilient deforming force of the ring-like elastic member.

Figure 5:
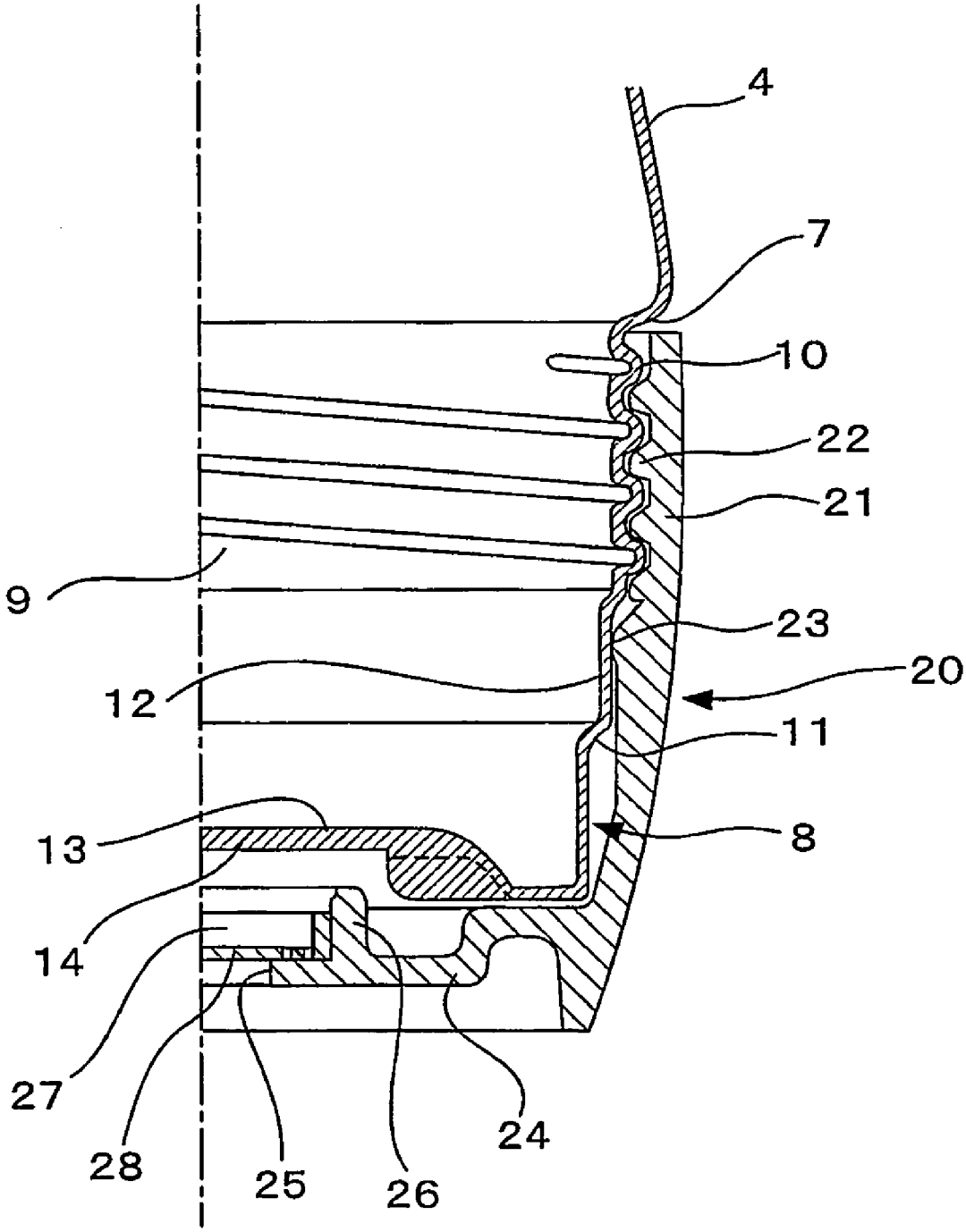
FIG. 5 is a vertical section of the right half of the bottom portion showing the bottom structure in another embodiment of this invention.
Figure 6:
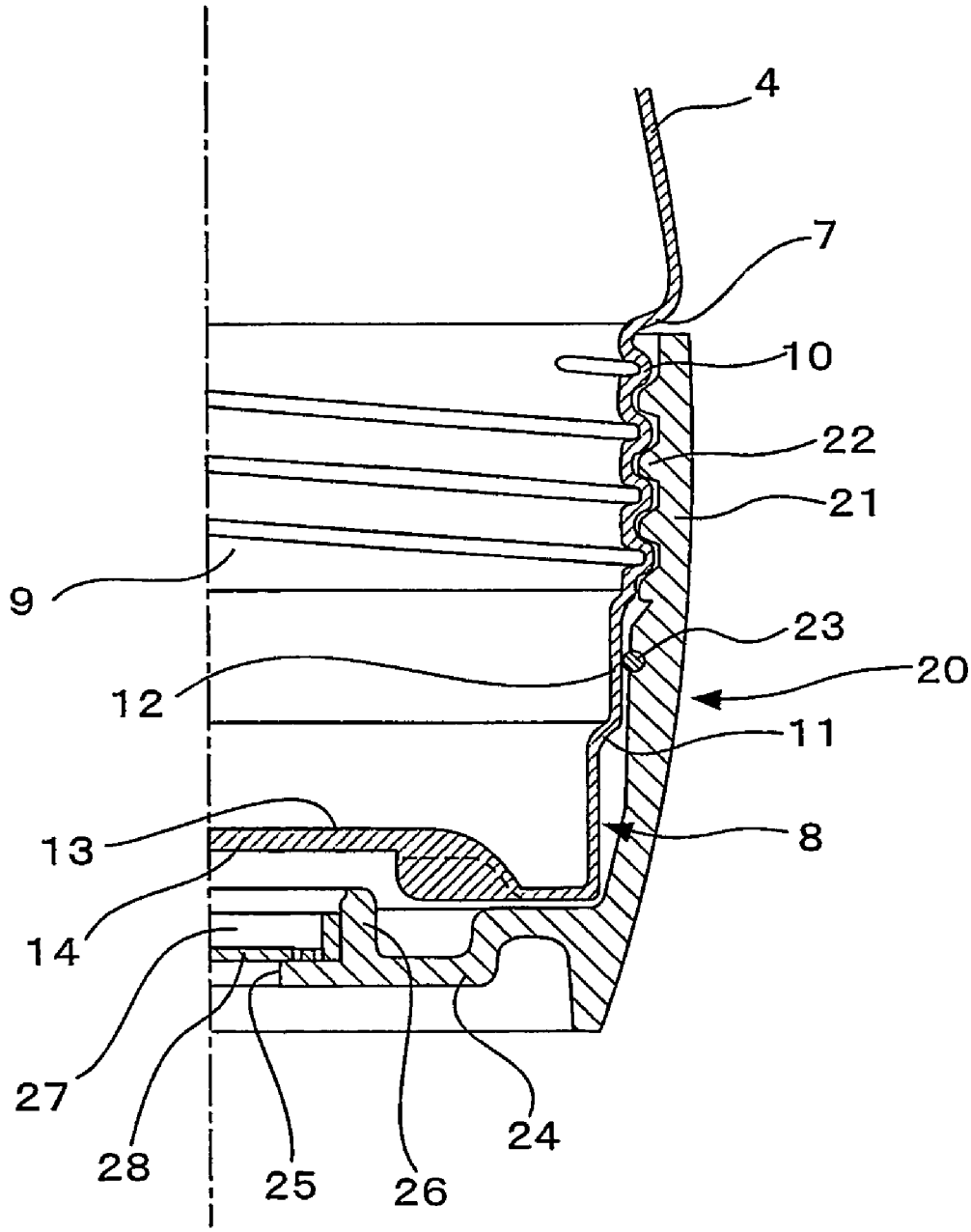
FIG. 6 is a vertical section of the right half of the bottom portion showing the bottom structure in another embodiment of this invention.

The second check valve 27 is fitted to the air intake hole 25 of the base cup 20. In the embodiments of FIGS. 2, 5, and 7, a valve support cylinder 26 is disposed on the cup bottom plate 24 so as to surround the air intake hole 25. The valve body 28 is held inside this valve support cylinder 26 to open or close the air intake hole 25.

Figure 8:
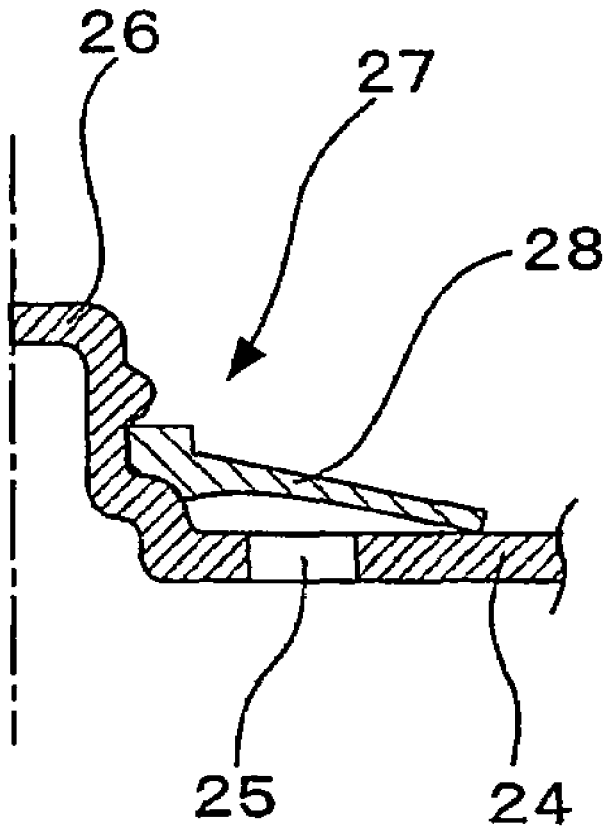
FIG. 8 is a partially enlarged sectional view of the second check valve in another embodiment of this invention.
Figure 9:
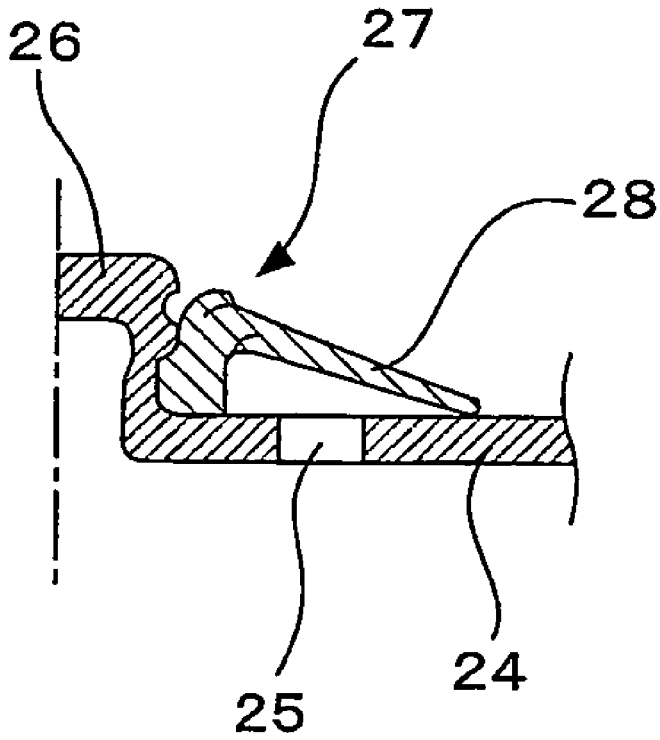
FIG. 9 is a partially enlarged sectional view of the second check valve in another embodiment of this invention.
Figure 10:
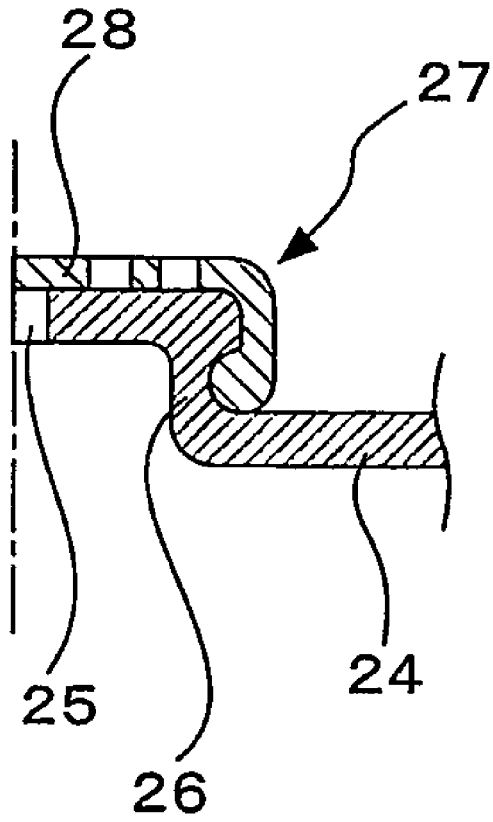
FIG. 10 is a partially enlarged sectional view of the second check valve in another embodiment of this invention.

The structure of this second check valve 27 is not limited to that described above. As shown in FIGS. 8 and 9, the valve support cylinder 26 with a top plate is disposed in the center of the cup bottom plate 24. In one more structure, the air intake hole 25 is opened along the inner wall of this valve support cylinder 26, and the second check valve 27 is fitted to the valve support cylinder 26 so that a ring-shaped valve body 28 covers, and open or close, the air intake hole 25. In another structure, the air intake hole 25 is opened in the top plate of the valve support cylinder 26, and the second check valve 27 having this air intake hole 25 opened or closed by the valve body 28 may be fitted into the valve support cylinder 26, as shown in FIG. 10.

Figure 11:
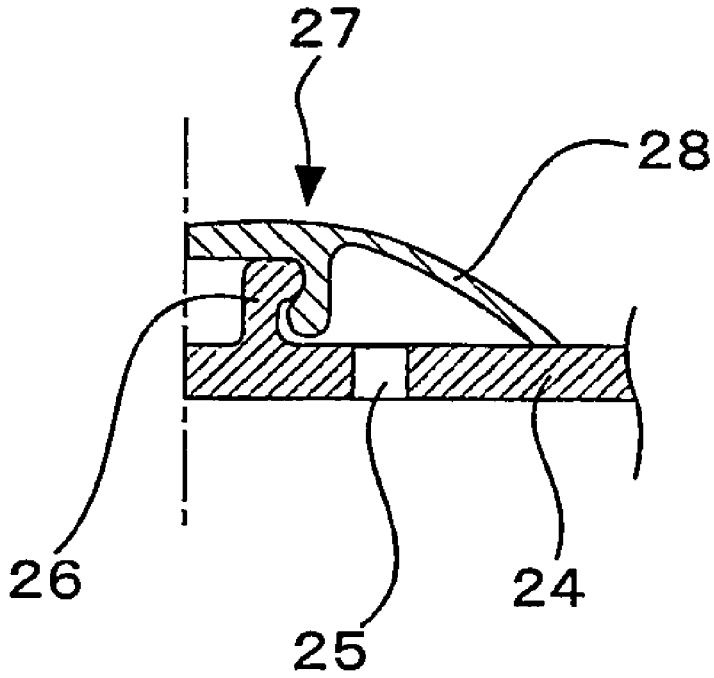
FIG. 11 is a partially enlarged sectional view of the second check valve in another embodiment of this invention.
Figure 12:
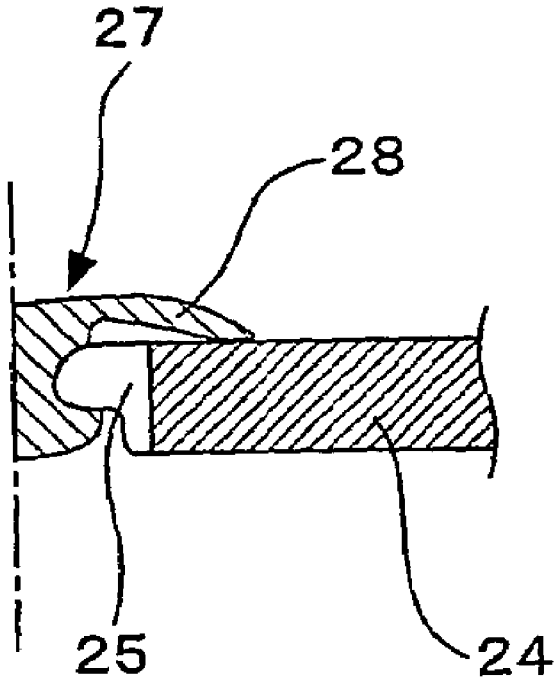
FIG. 12 is a partially enlarged sectional view of the second check valve in another embodiment of this invention.

In addition, as shown in FIG. 11, the second check valve 27 shown in FIG. 8 may have a valve support cylinder 26, which is provided with its own bottom. In still another structure, the second check valve 27 may not have any valve support cylinder 26 as shown in FIG. 12, but may have plural cuts along the edge of the air intake hole 25. These cuts are not sealed but are engaged with the periphery of the air intake hole 25 so that the second check valve 27 allows the valve body 28 to cover the entire air intake hole 25 including the cuts, and enables these cuts to be used as a practical air intake hole 25.

Connecting unit 29 is used to connect a comb attachment 33 to the squeezable container 1. This unit 29 comprises a screwing cylinder 30 to be screwed on the neck 6. A connecting cylinder 32 to be connected to the neck 6 stands in the center of a flat ring surface 31 disposed at the upper end of the screwing cylinder 30. Through the screw engagement with the neck 6, the connecting unit 29 ensures that inner lid gasket 16 is fitted into the neck 6, and also ensures that the first check valve 18 is fitted to the inner lid gasket 16.

The comb attachment 33 comprises the comb-back 35 that forms the main passage 37 through which the contents flow after having been discharged from the container 1; plural teeth 34, which are disposed straight in a row on one side of the comb-back 35 at equal intervals; and a fitting cylinder 36, which is suspended at the lower end of the comb-back 35 and is fitted tightly into the connecting cylinder 32 of the connecting unit 29. A pair of discharge ports 39 is disposed at a half height of each tooth, except for the uppermost tooth and the lowermost tooth. Each discharge port 39 is connected to the main passage 37 by way of a discharge path 38.

In the case of the embodiment shown in FIG. 1, a skirt-like cylinder widening toward the hem is disposed at the lower end of the comb-back 35 in such a way that the skirt covers the fitting cylinder 36. This cone-shaped cylinder is fitted around the wall that surrounds the flat ring surface 31, and thus strengthens and stabilizes the fitting of the comb attachment 33 to the connecting unit 29.

The comb attachment 33 may be fitted directly to the container 1 without utilizing any connecting unit 29. However, in that case, direct fitting of the comb attachment 33 to the container 1 should be strong enough to secure the tight fitting of the inner lid gasket 16 to the neck 6 and the stable fitting of the first check valve 18 to the inner lid gasket 16.

In the case of the embodiment shown in FIG. 1, plural teeth 34 are in the shape of a one-sided comb and are disposed straight in a row at equal intervals on one side of the comb-back 35 that forms the main passage 37 through which the contents flow after having been discharged from the container 1. The comb is not limited to the shape of this embodiment, but may have the shape of a both-sided comb in which the teeth are disposed at equal intervals on both sides of the comb-back 35, or may be in the shape of a brush in which two or more rows of teeth 34 are disposed widely on one side.

When the body 4 of the container 1 is squeezed, the inside of the inner layer 3 is always pressurized whatever direction the comb attachment 33 is aimed at. Since the first check valve 18 is actuated under the pressurized condition to open the neck 6, the contents such as a hair dye product flow through the main passage 37 and the discharge path 38, and are discharged from the discharge ports 39 into the spaces between the teeth. Then, the hair dye is applied onto the hair by combing the hair with the comb teeth 34.

As soon as the body 4 is released from the squeeze, the pressurized inside of the inner layer 3 falls into a reduced pressure condition, and the first check valve 18 is closed, thus preventing outside air and the discharged contents from flowing inside the inner layer 3.

When the body 4 is released from the squeeze, the outer layer begins restoring its original shape owing to the resilient recovery force. But since outside air does not enter the container 1 due to the work of the first check valve 18, the inner layer 3 remains deflated after it has been broken away from the outer layer 2, and the interspace between the outer layer 2 and the inner layer 3 is put under a negative pressure condition.

As a result, the second check valve 27 opens, and outside air passes through the air intake hole 25 of the base cup 20 and through the opening 15 of the container 1 into the interspace between the outer layer 2 and the inner layer 3. The outer layer 2 returns to its original shape.

Outside air is confined in the interspace between the outer layer 2 and the inner layer 3 when the second check valve 27 goes back to the closed state. If the body 4 of the container 1 is squeezed again under this condition, the inner layer 3 is pressurized, and the contents are discharged from the container 1.

EFFECTS OF THE INVENTION

This invention having the above-described configuration has the following effects:

In the invention of Claim 1, the base cup is fitted around the container 1 by the screw engagement. Even if the container 1 has high squeezability, the fitting strength between the base cup and the container never decreases. This fitting enables the resources saving to be accomplished. At the same time, it is possible to enhance the squeezability safely and to increase the easiness to use the container.

The container is provided with the first seal, which comes in tight contact with the second seal of the base cup. This contact ensures that the base cup is kept in tight contact with the bottom cylinder of the container.

In the invention of Claim 2, the first seal is disposed at a position near the lower overhang that serves as reinforcement. Even if the container has high squeezability, the overhang gives strength enough to keep the shape of the first seal. Thus, the tight fitting between the base cup and the bottom cylinder of the container can be maintained securely and firmly.

In the invention of Claim 3, an opening is formed by cleaving the pinch-off portion that has been formed in the outer layer along the parting line. The bottom is easily cleaved because of the laminated structure of the outer layer and the inner layer, which are not compatible with each other. The crack can be utilized as it is, and there is no need of troublesome molding operation and equipment for obtaining an opening.

In the invention of Claim 4, the sealing portions comprise a combination of a peripheral projecting ridge structure and a smooth peripheral wall structure. Because of such a simple configuration, the sealing portions can be properly molded by the blow molding method.

In the invention of Claim 5, the first seal comes in tight contact with the second seal by means of an elastic ring-shaped material. The resilient deforming force of this material can be utilized to make the tight contact strong and stable.

In the invention of Claim 6, the comb attachment is fitted to the container in such a way that the contents inside the container can be discharged into the spaces between plural teeth that have been aligned in a row. The user can squeeze out the contents directly into the spaces between the teeth, and can continuously apply the contents onto the hair, using this comb. Therefore, application of a hair dye onto the hair can be accomplished efficiently and favorably.

The invention claimed is:

1. A discharge container comprising:

a squeezable container, which has an outer layer with an aperture and an inner layer that are laminated to each other in a peelable manner, a neck disposed in the upper portion of said container and connected to discharge ports through which the contents are discharged, and the aperture disposed in said outer layer at a position in the bottom plate of container bottom cylinder so as to introduce outside air into the interspace between said outer layer and the inner layer;

a first check valve, which opens or closes said neck to prevent the contents from flowing back into said container and to inhibit the inflow of outside air;

a base cup in a bottomed cylindrical shape, which has a cylindrical wall that comes in screw engagement with said container bottom cylinder and also has an air intake hole opened in cup bottom plate; and a second check valve on the base cup and fitted to said air intake hole to permit outside air to enter the interspace between layers, wherein airtight fitting of peripheral bottom wall to the cylindrical wall is accomplished by tight contact between a first seal disposed on said peripheral bottom wall of the bottom cylinder and a second seal disposed on the back of said cylindrical wall.

2. The discharge container according to claim 1, wherein a lower overhang is disposed on the peripheral bottom wall of the bottom cylinder of the container and wherein the first seal is disposed at a position near this lower overhang.

3. The discharge container according to claim 1, wherein an opening is formed by cleaving a pinch-off portion that has been formed in the outer layer of said container bottom plate.

4. The discharge container according to claim 1, wherein either the first seal or the second seal has a peripheral projecting ridge structure, with the other having a smooth wall structure.

5. The discharge container according to claim 1, wherein either the first seal or the second seal is made of an elastic material in the shape of a ring, and is fitted to the peripheral bottom wall of the container bottom cylinder or to the cylindrical wall of the base cup.

6. The discharge container according to claim 1, wherein a comb attachment is fitted to neck, with said comb attachment comprising a row of combing teeth supported in a line on the comb-back having an internal main passage that connects to the neck of the container, and each tooth having front and rear discharge ports opened at a halfway point of the tooth height in the longitudinal direction of teeth and disposed face to face with opposite discharge ports of the next teeth, and each tooth also having a discharge path that connects said discharge ports to the main passage.

* * * * *